US011453953B2

(12) United States Patent
Tarutani et al.

(10) Patent No.: US 11,453,953 B2
(45) Date of Patent: Sep. 27, 2022

(54) HIGH-PURITY ELECTROLYTIC COPPER

(71) Applicant: MITSUBISHI MATERIALS CORPORATION, Tokyo (JP)

(72) Inventors: Yoshie Tarutani, Naka (JP); Kenji Kubota, Naka (JP); Kiyotaka Nakaya, Naka (JP); Isao Arai, Naka (JP)

(73) Assignee: MITSUBISHI MATERIALS CORPORATION, Tokyo (JP)

( * ) Notice: Subject to any disclaimer, the term of this patent is extended or adjusted under 35 U.S.C. 154(b) by 322 days.

(21) Appl. No.: 16/613,209

(22) PCT Filed: Jun. 1, 2018

(86) PCT No.: PCT/JP2018/021178
§ 371 (c)(1),
(2) Date: Nov. 13, 2019

(87) PCT Pub. No.: WO2018/221724
PCT Pub. Date: Dec. 6, 2018

(65) Prior Publication Data

US 2020/0173048 A1 Jun. 4, 2020

(30) Foreign Application Priority Data

| | | |
|---|---|---|
| Jun. 1, 2017 | (JP) | JP2017-109244 |
| Jun. 2, 2017 | (JP) | JP2017-110418 |
| May 21, 2018 | (JP) | JP2018-097318 |
| May 21, 2018 | (JP) | JP2018-097319 |

(51) Int. Cl.
*C25C 1/12* (2006.01)
*C22C 9/00* (2006.01)

(52) U.S. Cl.
CPC . *C25C 1/12* (2013.01); *C22C 9/00* (2013.01)

(58) Field of Classification Search
CPC ..... C22C 9/00
See application file for complete search history.

(56) References Cited

U.S. PATENT DOCUMENTS

| | | | | |
|---|---|---|---|---|
| 4,792,369 | A | 12/1988 | Ogata et al. | |
| 9,435,016 | B2 | 9/2016 | Sakurai et al. | |
| 2004/0249177 | A1 | 12/2004 | Wang et al. | |
| 2008/0223728 | A1 | 9/2008 | Shindo et al. | |
| 2013/0319584 | A1 | 12/2013 | Sakurai et al. | |
| 2013/0334057 | A1 | 12/2013 | Watanabe et al. | |
| 2016/0355939 | A1 | 12/2016 | Thorum | |
| 2017/0088963 | A1 | 3/2017 | Tarutani et al. | |
| 2018/0237901 | A1 * | 8/2018 | Mori | C22F 1/08 |
| 2019/0203369 | A1 | 7/2019 | Si et al. | |

FOREIGN PATENT DOCUMENTS

| | | | | |
|---|---|---|---|---|
| CN | 101985700 | A | 3/2011 | |
| CN | 105814233 | A | 7/2016 | |
| JP | 53-203784 | A | 8/1988 | |
| JP | 02-185990 | A | 7/1990 | |
| JP | 02-294495 | A | 12/1990 | |
| JP | 03-140489 | A | 6/1991 | |
| JP | 04-365889 | A | 12/1992 | |
| JP | 06-173063 | A | 6/1994 | |
| JP | 08-000990 | B2 | 1/1996 | |
| JP | 2001-123289 | A | 5/2001 | |
| JP | 2004-315849 | A | 11/2004 | |
| JP | 2005-307343 | A | 11/2005 | |
| JP | 2005-533187 | A | 11/2005 | |
| JP | 4620185 | B2 | 1/2011 | |
| JP | 4706081 | B2 | 6/2011 | |
| JP | 2014-015677 | A | 1/2014 | |
| JP | 2017-043834 | A | 3/2017 | |
| JP | 2017-066514 | A | 4/2017 | |
| WO | 2004/011691 | A1 | 2/2004 | |
| WO | 2016/052727 | A1 | 4/2016 | |
| WO | 2017/033694 | A1 | 3/2017 | |
| WO | WO-2017033694 | A1 * | 3/2017 | C25C 7/02 |

OTHER PUBLICATIONS

Machine translatin of JP H06173063A (Year: 1994).*
Yi Guangbin, "Mechanism on Warping and Microstructure and Mechanical Properties of Electrolytic Copper Foils," China doctoral dissertation full text database, Engineering Science and Technology I, Chapters 2-4, May 15, 2015, pp. 21-92. (cited in the Dec. 2, 2020 Office Action issued for CN201880015294.1, See English translation of the Dec. 2, 2020 CN OA for concise explanation(s) of the relevance).
Office Action dated Dec. 2, 2020, issued for Chinese Patent Application No. 201880015294.1 and English translation thereof.
International Search Report dated Aug. 21, 2018, issued for PCT/JP2018/021178 and English translation thereof.
International Search Report dated Aug. 21, 2018, issued for PCT/JP2018/021228 and English translation thereof.
Office Action dated Mar. 30, 2021, issued for U.S. Appl. No. 16/617,574.
Final Office Action dated Sep. 3, 2021, issued for U.S. Appl. No. 16/617,574.
Supplementary European Search Report dated Jan. 27, 2021, issued for European Patent Application No. 18809582.2.
Hiroaki Nakano et al., "Synergistic Effect of Additives on Morphology and Texture of Copper Deposited from Electrorefining Solution," Journal of MMIJ vol. 127, p. 662-666(2011).

(Continued)

*Primary Examiner* — Christopher S Kessler

(74) *Attorney, Agent, or Firm* — Locke Lord LLP; James E. Armstrong, IV; Nicholas J. DiCeglie, Jr.

(57) ABSTRACT

The present invention provides a high-purity electrolytic copper 10 having a Cu purity excluding gas components (O, F, S, C, and Cl) is 99.9999 mass % or more, a content of S is 0.1 mass ppm or less, and an area ratio of crystals having a (101)±10° orientation is less than 40%, when crystal orientation is measured by electron backscatter diffraction in a cross section along a thickness direction.

8 Claims, 1 Drawing Sheet

(56) References Cited

OTHER PUBLICATIONS

List of the papers of Journal of MMIJ vol. 127, No. 10-11. (Indicating publication date of Nakano NPL).
National Center for Biotechnology Information, PubChem Compound Summary for CID 67519, 1H-Tetrazole, PubChem, Created Mar. 26, 2005, <https://pubchem.ncbi.nlm.nih.gov/compound/1H-Tetrazole>. Accessed May 26, 2022. (Year: 2005).
T. Konkova, S. Mironov, A. Korznikov, S.L. Semiatin, On the; room-temperature annealing of cryogenically rolled copper; Materials Science and Engineering: A, vol. 528, Issue 24, 2011, pp. 7432-7443, (Year: 2011).
Office Action issued in U.S. Appl. No. 16/617,574, dated Jun. 3, 2022.

* cited by examiner

HIGH-PURITY ELECTROLYTIC COPPER

TECHNICAL FIELD

The present invention relates to a high-purity electrolytic copper that has a Cu purity excluding gas components (0, F, S, C, and Cl) of 99.9999 mass % or more and is electrodeposited on a surface of a cathode plate due to electrolytic refining.

Priority is claimed on Japanese Patent Application No. 2017-109244, filed on Jun. 1, 2017, Japanese Patent Application No. 2017-110418, filed on Jun. 2, 2017, and Japanese Patent Application Nos. 2018-097318 and 2018-097319, filed on May 21, 2018, the content of which is incorporated herein by reference.

BACKGROUND ART

A high-purity copper having a Cu purity excluding gas components (O, F, S, C, and Cl) of 99.9999 mass % or more is, for example, used in a sputtering target, a bonding wire, an audio cable, or an accelerator.

As means for obtaining such a high-purity copper, an electrolytic refining method of dipping an anode plate, for example, formed of a copper sheet having a purity of approximately 99.99 mass % and a cathode plate, for example, formed of a stainless steel sheet in an electrolyte containing copper ions, and applying an electric current thereto, to cause electrodeposition of copper having a high purity on a surface of the cathode plate due to an electrolytic reaction is widely used. Then, the copper electrodeposited on the surface of the cathode plate is peeled off to obtain an electrolytic copper having a higher purity that of the anode plate.

For example, PTL 1 discloses a method of re-electrolyzing a copper obtained by electrolytic refinement in a copper sulfate aqueous solution, in a nitric acid aqueous solution at current density of 100 $A/m^2$ or less, to obtain a high-purity electrolytic copper.

In addition, PTL 2 discloses a high-purity copper having regulated grain size and particle number of non-metal inclusions included as impurities.

Here, in the electrolytic refining method described above, an additive (for example, glue) for preventing the electrolytic reaction is normally added in an electrolyte, in order to control the state of the copper electrodeposited on the cathode plate. However, the glue described above contains sulfur, and accordingly, the sulfur content in copper obtained by electrodeposition tends to increase.

Therefore, PTL 3 discloses that polyethylene glycol (PEG) or polyvinyl alcohol (PVA) is used as the additive, in order to decrease the content of sulfur in copper obtained by electrodeposition. In a case where the effect of the additive for controlling the electrolytic reaction is insufficient or excessive, ruggedness is generated on a surface of the copper electrodeposited on the surface of the cathode plate or abnormal electrodepositions such as dendrites are generated. The electrolyte is captured in this abnormal portion and the purity of electrolytic copper cannot be sufficiently improved. Thus, the control of the additive is extremely important.

CITATION LIST

Patent Literature

[PTL 1] Japanese Examined Patent Application, Second Publication No. H08-000990

[PTL 2] Japanese Unexamined Patent Application, First Publication No. 2005-307343

[PTL 3] Japanese Patent No. 4620185(B)

DISCLOSURE OF INVENTION

Technical Problem

However, when using an additive of the related art, an electrolytic reaction of the cathode plate is excessively prevented, and stress in electrodeposits tends to increase. Warpage occurs on the copper electrodeposited on the surface of a cathode plate due to this stress in electrodeposits, thereby causing copper to fall during electrolysis, and an electrolytic copper may not be stably produced. In addition, even in a case where an electrolytic copper is obtained without the copper falling during the electrolysis, when the electrolytic copper is peeled off from the cathode plate and left, a warpage occurs due to stress in electrodeposits (residual stress) remaining on the electrolytic copper, and the handling thereafter may be difficult.

The invention is made in circumstances of the problems described above, and an object thereof is to provide a high-purity electrolytic copper that has a Cu purity excluding gas components of 99.9999 mass % or more, has a content of S of 0.1 mass ppm or less, is stably produced by decreasing stress in electrodeposits during electrodeposition, and has good handleability due to the prevention of a warpage, even after being peeled off from the cathode plate.

Solution to Problem

In order to achieve the object described above, a high-purity electrolytic copper of the disclosure is provided, in which the Cu purity excluding gas components (O, F, S, C, and Cl) is 99.9999 mass % or more, a content of S is 0.1 mass ppm or less, and an area ratio of crystals having a (101)±10° orientation is less than 40%, when crystal orientation is measured by electron backscatter diffraction in a cross section along a thickness direction.

In the high-purity electrolytic copper having this configuration, the area ratio of crystals having a (101)±10° orientation is suppressed to be less than 40% in the cross section along the thickness direction (that is, cross section along a growth direction of electrodeposition), and accordingly, the crystals having a (101)±10° orientation are prevented from greatly growing due to an electrolytic reaction, and stress in electrodeposits during the electrodeposition decreases. In addition, strain can be dispersed due to a random orientation of crystals. Therefore, by preventing the occurrence of warpage, even after the electrolytic copper is peeled off from the cathode plate, good handleability is obtained.

In addition, the purity of Cu excluding gas components (O, F, S, C, and Cl) is 99.9999 mass % or more and the content of S is 0.1 mass ppm or less, and accordingly, the high-purity electrolytic copper can be used for various purposes requiring a high purity.

Here, in the high-purity electrolytic copper of the invention, it is preferable that an area ratio of crystals having a (111)±10° orientation is less than 15%, when crystal orientation is measured by electron backscatter diffraction in the cross section along the thickness direction.

In this case, the area ratio of crystals having a (111)±10° orientation is less than 15% in the cross section along the thickness direction (that is, cross section along a growth direction of electrodeposition), and accordingly, the crystals having a (111)±10° orientation are prevented from greatly growing due to an electrolytic reaction, and stress in electrodeposits during the electrodeposition decreases. In addition, strain can be dispersed due to a random orientation of crystals. Therefore, by preventing the occurrence of warpage, even after the electrolytic copper is peeled off from the cathode plate, good handleability is obtained.

In the high-purity electrolytic copper of the invention, it is preferable that an area ratio of crystal grains, in which an aspect ratio b/a represented by a major axis a of the crystal grain and a minor axis b orthogonal to the major axis a is less than 0.33, is less than 40% in the cross section along the thickness direction (cross section along the growth direction of electrodeposition).

In this case, the area ratio of the crystal grains in which the aspect ratio b/a is less than 0.33 is suppressed to be low, and accordingly, strain accumulated on the crystal grains can be relaxed, the occurrence of warpage is prevented, even after the electrolytic copper is peeled off from the cathode plate, and good handleability is obtained.

In the high-purity electrolytic copper of the invention, it is preferable that the purity of Cu excluding gas components (O, F, S, C, and CO is 99.99999 mass % or more and the content of S is 0.02 mass ppm or less.

In this case, the purity of Cu excluding gas components (O, F, S, C, and Cl) is 99.99999 mass % or more and the content of S is 0.02 mass ppm or less, and accordingly, the electrolytic copper can also be applied where a copper having a higher purity is required.

Advantageous Effects of Invention

According to the invention, the purity of Cu excluding the gas components is 99.9999 mass % or more and the content of S is 0.1 mass ppm or less, and therefore, it is possible to provide a high-purity electrolytic copper that is capable of being stably produced by decreasing stress in electrodeposits during electrodeposition, and has good handleability, by preventing the occurrence of warpage, even after the electrolytic copper is peeled off from a cathode plate.

BEST MODE FOR CARRYING OUT THE INVENTION

Hereinafter, a high-purity electrolytic copper according to one embodiment of the invention will be described.

Figure 1A:
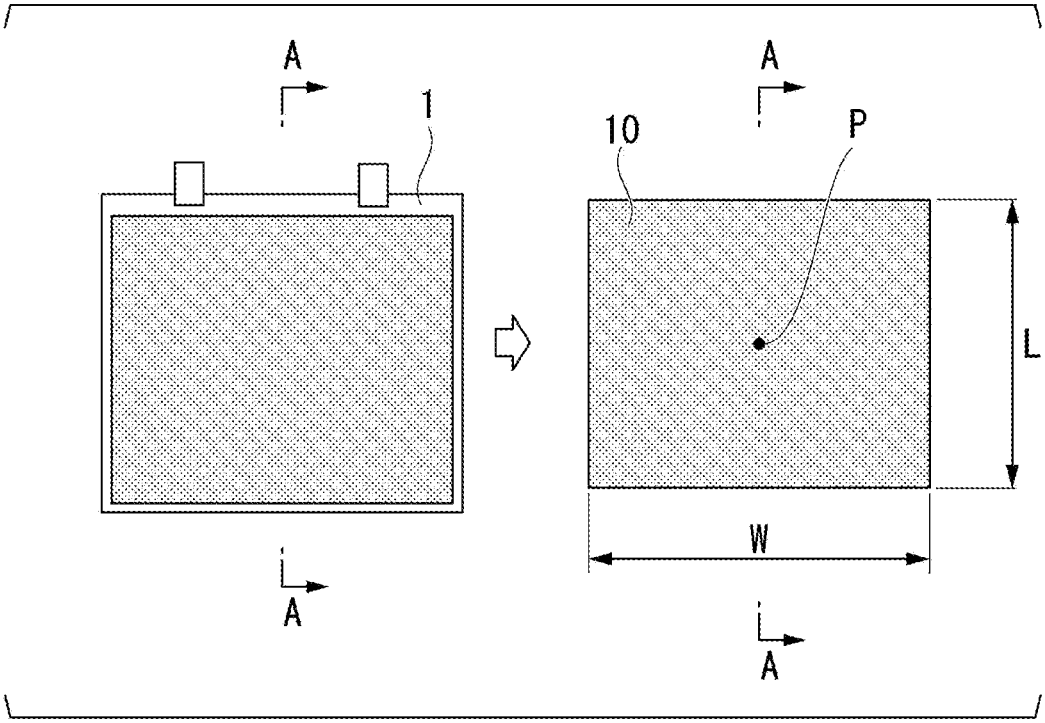
FIG. 1A is schematic explanatory views and front views of a high-purity electrolytic copper of an embodiment of the invention.
Figure 1B:
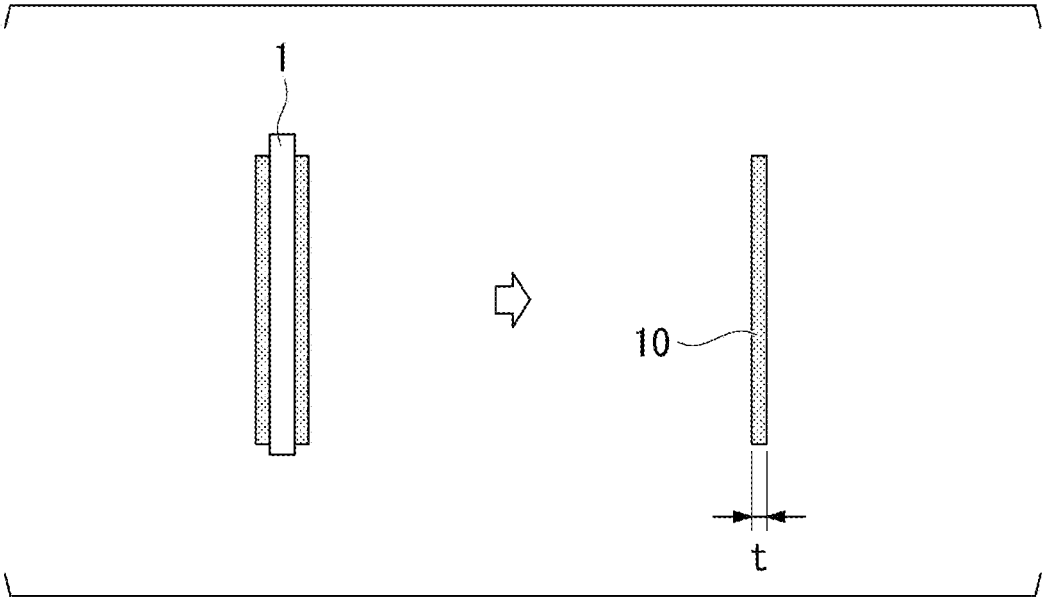
FIG. 1B is schematic explanatory views and A-A cross-sectional views of the high-purity electrolytic copper of the embodiment of the invention.

As shown in FIGS. 1A and 1B, a high-purity electrolytic copper 10 according to the embodiment is obtained by electrodeposition on a surface of a cathode plate 1 during electrolytic refinement and has a plate shape when peeled off from the cathode plate 1 (that is, a high-purity electrolytic copper sheet). On the cathode plate 1 during the electrolytic refinement, an electrodeposition prevention tape or the like is disposed on a peripheral portion excluding the upper portion of the cathode plate 1, in order to prevent contact between electrolytic coppers electrodeposited on both surfaces of the cathode plate 1 and obtain an electrolytic copper having a desired size. In the embodiment, the thickness t of the high-purity electrolytic copper 10 is in a range of 1 mm≤t≤100 mm. The plate width W and the plate length L of the high-purity electrolytic copper 10 are respectively in a range of 0.05 m≤W≤5 m and in a range of 0.05 m≤L≤5 m.

In a composition of the high-purity electrolytic copper 10 according to the embodiment, the Cu purity excluding O, F, S, C, and Cl which are gas components is 99.9999 mass % (6N) or more and the content of S is 0.1 mass ppm or less. The purity of Cu excluding O, F, S, C, and Cl which are gas components is preferably 99.99999 mass % (7N) or more. An upper limit value of the purity of Cu excluding O, F, S, C, and Cl which are gas components is not particularly limited and is preferably 99.999999 mass % (8N) or less. In addition, the content of S is preferably 0.02 mass ppm or less. A lower limit value of the content of S is not particularly limited and is preferably 0.001 mass ppm or more.

The analysis of impurity elements can be performed by using a glow discharge mass spectrometer (GD-MS).

In the high-purity electrolytic copper 10 according to the embodiment, an area ratio of crystals having a (101)±10° orientation is less than 40%, when crystal orientation is measured by electron backscatter diffraction in a cross section along a thickness direction (A-A cross section in FIG. 1B).

In addition, in the high-purity electrolytic copper 10 according to the embodiment, the area ratio of crystals having a (111)±10° orientation is less than 15%, when crystal orientation is preferably measured by electron backscatter diffraction in the cross section along the thickness direction (A-A cross section in FIG. 1B).

Here, in the embodiment, in the crystal orientation analysis by an electron backscatter diffraction method, a boundary between adjacent pixels having misorientation of 5° or more is assumed as a crystal grain boundary, and the area ratio of crystals having a (101)±10° orientation and area ratio of crystals having a (111)±10° orientation are measured.

In the high-purity electrolytic copper 10 according to the embodiment, in the cross section along a thickness direction (A-A cross section in FIG. 1B), the area ratio of crystal grains, in which an aspect ratio b/a represented by a major axis a of a crystal grain size and a minor axis b orthogonal to the major axis a is less than 0.33, is preferably less than 40%.

Here, in the embodiment, in the crystal orientation analysis by the electron backscatter diffraction method, a boundary between adjacent pixels having misorientation of 5° or more is assumed as a crystal grain boundary, the recognized crystal grain approximates to an elliptical shape, an aspect ratio b/a which is a ratio of a major diameter a and a minor diameter b of the ellipse is calculated, and an area ratio of crystal grains in which the aspect ratio b/a is less than 0.33 is measured.

In the high-purity electrolytic copper 10 according to the embodiment, in the cross section along the thickness direction (A-A cross section in FIG. 1B), an average crystal grain size is preferably 15 μm to 35 μm.

In the embodiment, in the crystal orientation analysis by the electron backscatter diffraction method, a boundary between adjacent pixels having misorientation of 5° or more is assumed as a crystal grain boundary, the obtained crystal grain approximates to a circular shape of circles having the same area, and each crystal grain size is calculated by assuming a diameter of the circle as the crystal grain size. In this case, a crystal grain, part of which is outside of the measuring field, is not a target of measurement. In addition, the average crystal grain size is calculated by the following expression.

[Expression 1]

$$r_{ave} = \frac{\sum_{r=0}^{\infty} N_{(r)} \cdot S_{(r)}}{\sum_{r=0}^{\infty} S_{(r)}}$$

$r_{ave}$: average crystal grain size

S: grain area r: grain diameter

N: grain number

In the high-purity electrolytic copper 10 according to the embodiment, a glossiness of the surface is preferably equal to or greater than 2.

In the embodiment, the measurement is performed regarding a center part (a point Pin FIG. 1A) of the surface of the high-purity electrolytic copper 10 at an angle of incidence of 60° using a gloss meter based on JIS Z 8741:1997 (corresponding to ISO 2813:1994 and ISO 7668: 1986).

Hereinafter, the reason for regulations of the area ratio of crystals having a (101)±10° orientation, the area ratio of crystals having a (111)±10° orientation, the area ratio of crystal grains in which the aspect ratio b/a represented by the major axis a of the crystal grain size and the minor axis b orthogonal to the major axis a is less than 0.33, and the average crystal grain size in a cross section along the thickness direction of the high-purity electrolytic copper 10 according to the embodiment (cross section along a growth direction of copper electrodeposited on the surface of the cathode plate 1), and the glossiness of the surface of the high-purity electrolytic copper, as described above will be described.

(Area Ratio of Crystals Having (101)±10° Orientation: Less than 40%)

When the crystals having a (101)±10° orientation is greatly grown, in a case where the copper is electrodeposited on the surface of the cathode plate 1 and the crystals are grown, it is difficult for strain generated during the electrodeposition of the copper to become relaxed, and stress in electrodeposits increases. Accordingly, warpage easily occurs on the electrodeposited copper.

Therefore, in the embodiment, the area ratio of crystals having a (101)±10° orientation in a cross section along the thickness direction is set to be less than 40% and a percentage of crystals grown in one direction is set to be low.

In order to further prevent stress in electrodeposits, the area ratio of crystals having a (101)±10° orientation in a cross section along the thickness direction is preferably 30% or less. A lower limit value of the area ratio of crystals having a (101)±10° orientation in a cross section along the thickness direction is not particularly limited and is preferably 5% or more.

(Area Ratio of Crystals Having (111)±10° Orientation: Less than 15%)

When the crystals having a (111)±10° orientation is greatly grown, in a case where the copper is electrodeposited on the surface of the cathode plate 1 and the crystals are grown, it is difficult for strain generated during the electrodeposition of the copper to become relaxed, and stress in electrodeposits increases. Accordingly, a warpage easily occurs on the electrodeposited copper. Here, by setting the area ratio of crystals having a (111)±10° orientation to be less than 15%, strain generated during the electrodeposition of the copper is easily relaxed, stress in electrodeposits decreases, and a warpage of the electrodeposited copper can be further prevented.

Therefore, in the embodiment, the area ratio of crystals having a (111)±10° orientation in a cross section along the thickness direction is set to be less than 15% and a percentage of crystals grown in one direction is set to be low.

In order to further prevent stress in electrodeposits, the area ratio of crystals having a (111)±10° orientation in a cross section along the thickness direction is preferably 10% or less. A lower limit value of the area ratio of crystals having a (111)±10° orientation in a cross section along the thickness direction is not particularly limited, and is preferably 2% or more.

(Area Ratio of Crystal Grains in which Aspect Ratio b/a is Less than 0.33:40% or Less)

In a case where the aspect ratio of crystal grains of copper electrodeposited on the surface of the cathode plate 1 is less than 0.33, the crystal grain is elongated and a great amount of strain is accumulated. Accordingly, stress remaining in the high-purity electrolytic copper 10 tends to be comparatively high. Here, by setting the area ratio of crystal grains in which the aspect ratio b/a is less than 0.33 to be 40% or less, it is possible to suppress the stress remaining in the high-purity electrolytic copper 10 to be sufficiently low.

Therefore, in the embodiment, the area ratio of crystal grains in which the aspect ratio b/a is less than 0.33 in the cross section along the thickness direction is regulated to be 40% or less.

In order to further prevent the stress remaining in the high-purity electrolytic copper 10, the area ratio of crystal grains in which the aspect ratio b/a is less than 0.33 is preferably 20% or less. A lower limit value of the area ratio of crystal grains in which the aspect ratio b/a is less than 0.33 is not particularly limited, and is preferably 5% or more.

(Average Crystal Grain Size: 15 μm to 35 μm)

In a case where the crystal grain size is small, the number of portions where electrodeposited crystals are fused increase, strain generated during the fusion is accumulated, and stress in electrodeposits over the entire area tends to increase. On the other hand, in a case where the crystal grain size is great, a surface of an electrolytic copper becomes coarse along therewith, an electrolyte is easily mixed during the electrodeposition, and a purity of the electrolytic copper tends to decrease.

Therefore, in the embodiment, the average crystal grain size is set to be 15 μm to 35 μm. The average crystal grain size is more preferably 15 μm to 30 μm.

(Glossiness of Surface: 2 or More)

In a case where ruggedness is generated on a surface of copper electrodeposited on the surface of the cathode plate 1, the electrolyte is captured in the portion of the ruggedness, and the purity of the electrolytic copper tends to decrease.

Therefore, in the high-purity electrolytic copper 10 of the embodiment, the glossiness of the surface is set to be 2 or more.

The glossiness of the surface of the high-purity electrolytic copper 10 is preferably 3 or more. An upper limit value of the glossiness of the surface is not particularly limited and is preferably 4.5 or less.

Here, in a case where the copper is smoothly electrodeposited on the surface of the cathode plate 1 to increase the glossiness, stress in electrodeposits tends to increase, and accordingly, as described above, it is more preferable that an orientation degree of crystals is regulated, and the stress remaining in the electrolytic copper (remaining stress) is decreased to prevent occurrence of a warpage.

Next, a method for producing the high-purity electrolytic copper 10 according to the embodiment will be described.

In the method for producing the high-purity electrolytic copper 10 according to the embodiment, a copper sulfate aqueous solution is used as an electrolyte, a concentration of sulfuric acid in the electrolyte is 10 g/L or more and 300 g/L or less, a concentration of copper is 5 g/L or more and 90 g/L or less, and a concentration of chloride ions is 5 mg/L or more and 150 mg/L or less.

In the method for producing the high-purity electrolytic copper 10 according to the embodiment, additives added to the electrolyte have characteristical features. In the embodiment, as will be described later, three kinds of additives such as an additive A (silver reducing agent), an additive B (electrodeposition state control agent), and an additive C (stress relaxation agent) are used.

(Additive A: Silver Reducing Agent)

The additive A (silver reducing agent) is formed of tetrazole or a derivative thereof (hereinafter, tetrazoles). Examples of a tetrazole derivative include 5-amino-1H-tetrazole, 5-methyl-1H-tetrazole, 5-phenyl-1H-tetrazole, and 1-methyl-5-ethyl-1H-tetrazole.

By adding the tetrazoles to the electrolyte, silver ions in the electrolyte are complexed to inhibit the precipitation, and a content of Ag which is inevitable impurities can be decreased. The content of Ag in the high-purity electrolytic copper of the embodiment is preferably 0.1 mass ppm or less and more preferably 0.001 mass ppm or more and 0.09 mass ppm or less.

Here, by setting the additive amount of the tetrazoles to be 0.1 mg/L or more, it is possible to sufficiently prevent eutectoid of silver. On the other hand, by setting the additive amount of the tetrazoles to be 20 mg/L or less, an electrodeposition state is stabilized, generation of coarse dendrites is prevented, and the purity is sufficiently improved.

From the above viewpoints, in the embodiment, the additive amount of the tetrazoles is set to be 0.1 mg/L or more and 20 mg/L or less. An upper limit of the additive amount of the tetrazoles is preferably 10 mg/L or less.

(Additive B: Electrodeposition State Control Agent)

The additive B (electrodeposition state control agent) is formed of polyoxyethylene monophenyl ether or polyoxyethylene naphthyl ether (hereinafter, polyoxyethylene monophenyl ethers).

By adding polyoxyethylene monophenyl ethers to the electrolyte, the surface of electrolytic copper become smooth and generation of abnormal precipitation such as dendrites can also be prevented. Therefore, the inclusion of the electrolyte is reduced, and the amount of inevitable impurities such as sulfur can be further decreased.

Here, in a case where the additive amount of polyoxyethylene monophenyl ethers is 10 mg/L or more or 500 mg/L or less, it is possible to sufficiently decrease the amount of inevitable impurities.

From the above viewpoints, in the embodiment, the additive amount of polyoxyethylene monophenyl ethers is set to be 10 mg/L or more and 500 mg/L or less. The additive amount of polyoxyethylene monophenyl ethers is more preferably 50 mg/L or more and 300 mg/L or less.

(Additive C: Stress Relaxation Agent)

The additive C (stress relaxation agent) is formed of polyvinyl alcohol or modified polyvinyl alcohol (hereinafter, polyvinyl alcohols). Examples of modified polyvinyl alcohol include polyoxyethylene-modified polyvinyl alcohol, ethylene-modified polyvinyl alcohol, and carboxy-modified polyvinyl alcohol.

By adding polyvinyl alcohols to the electrolyte, it is possible to prevent the growth of crystals in one direction and to disperse strain by randomly setting the orientation of crystals. In addition, by adding polyvinyl alcohols to the electrolyte, it is possible to suitably alleviate an electrodeposition prevention effect of the additive, and accordingly, it is possible to coarse the size of the crystal grain. Therefore, it is possible to decrease stress in electrodeposits, for example, decrease stress in electrodeposits, in a case where the electrodeposition is performed to have a film thickness of 20 to 100 μm, to be 50 MPa or less. As a thickness of a copper film to be electrodeposited increases, the strain is accumulated in the copper film, and stress in electrodeposits tends to further increase.

Here, by setting the additive amount of polyvinyl alcohols to be 1 mg/L or more, it is possible to sufficiently decrease stress in electrodeposits. On the other hand, by setting the additive amount of polyvinyl alcohols to be 100 mg/L or less, the effect of decreasing stress in electrodeposits is sufficiently exhibited, and generation of great dendrites can be reliably prevented.

From the above viewpoints, in the embodiment, the additive amount of polyvinyl alcohols is set to be 1 mg/L or more and 100 mg/L or less. An upper limit of the additive amount of the polyvinyl alcohols is preferably 50 mg/L or less.

By setting a saponification rate of the polyvinyl alcohols to be 70 mol % or more, it is possible to sufficiently decrease stress in electrodeposits. On the other hand, by setting the saponification rate to be 99 mol % or less, solubility is ensured and the polyvinyl alcohols can be reliably dissolved in the electrolyte.

From the above viewpoints, in the embodiment, the saponification rate of the polyvinyl alcohols is set to be 70 mol % or more and 99 mol % or less. The saponification rate of the polyvinyl alcohols is more preferably 75 mol % or more and 95 mol % or less.

A basic structure of polyvinyl alcohols is formed of a fully saponified type of a hydroxyl group and a partially saponified type of an acetic acid group, a polymerization degree of polyvinyl alcohols is a total number of both thereof, and an average polymerization degree is an average value of polymerization degrees. The average polymerization degree can be measured based on a polyvinyl alcohol test method regulated in JIS K 6726:1994.

Here, by setting the average polymerization degree of polyvinyl alcohols to be 200 or more, it is possible to sufficiently decrease stress in electrodeposits. On the other hand, by setting the average polymerization degree of polyvinyl alcohols to be 2500 or less, it is possible to sufficiently decrease stress in electrodeposits and to prevent a decrease in yield of electrolytic copper due to the electrodeposition prevention effect.

From the above viewpoints, in the embodiment, the average polymerization degree of polyvinyl alcohols is set to be 200 or more and 2500 or less.

A copper sheet formed of copper (4NCu) having a purity of 99.99 mass % or more as an anode plate is dipped into the electrolyte, to which the additives are added, as described above, a stainless steel sheet is dipped therein as the cathode plate 1, and the anode plate and cathode plate 1 are energized to electrodeposit copper on the surface of the cathode plate 1.

By peeling the copper electrodeposited on the surface of the cathode plate 1, the high-purity electrolytic copper 10 according to the embodiment is produced.

Here, by setting a current density during the electrodeposition to be 150 $A/m^2$ or more, coarsening of the grain size can be prevented. In addition, it is possible to prevent an increase in eutectoid amount of Ag with respect to Cu and to prevent an increase in amount of Ag in the electrolytic copper. On the other hand, by setting the current density during the electrodeposition to be 190 A/m$^2$ or less, the grain size is ensured, and it is possible to prevent an increase in stress in electrodeposits. For example, in the copper sulfate electrolyte, it is possible to prevent a speed of dissolution of copper sulfate generated due to the dissolution from anode, in the electrolyte, to be slower than the anode dissolution speed, and it is possible to prevent an increase in interpolar voltage due to inhibiting energization by covering the anode surface with crystals of copper sulfate.

From the above viewpoints, in the embodiment, a current density during the electrodeposition is preferably 150 A/m$^2$ or more and 190 A/m$^2$ or less. The current density during the electrodeposition is more preferably 155 A/m$^2$ or more and 185 A/m$^2$ or less.

In addition, by setting an electrolyte temperature during the electrodeposition to be equal to or higher than 30° C., the grain size is ensured, and it is possible to prevent an increase in stress in electrodeposits. For example, in the copper sulfate electrolyte, the crystals of copper sulfate are hardly formed on the anode surface, and it is possible to prevent an increase in interpolar voltage by inhibiting energization. On the other hand, by setting the electrolyte temperature during the electrodeposition to be equal to or lower than 35° C., coarsening of the grain size can be prevented. In addition, it is possible to prevent an increase in saturated solubility of Ag ions in the electrolyte, prevent an increase in concentration of Ag ions in the electrolyte, and prevent increase in amount of Ag in the electrolytic copper.

From the above viewpoints, in the embodiment, the electrolyte temperature during the electrodeposition is preferably 30° C. to 35° C.

According to the high-purity electrolytic copper 10 according to the embodiment having a configuration described above, the area ratio of crystals having a (101) ±10° orientation is suppressed to be less than 40%, in the cross section along the thickness direction (cross section along a growth direction of electrodeposition), and accordingly, the great growth of the crystals having a (101)±10° orientation due to the electrolytic reaction is prevented, and stress in electrodeposits during the electrodeposition is suppressed to be low. In addition, the orientation of crystals becomes random and the strain is easily relaxed. Accordingly, the occurrence of a warpage of the plate-shaped high-purity electrolytic copper 10 peeled off from the cathode plate 1 is prevented, and good handleability is obtained.

The purity of Cu excluding gas components (O, F, S, C, and Cl) is 99.9999 mass % or more and the content of S is 0.1 mass ppm or less, and the purity of Cu excluding gas components (O, F, S, C, and Cl) is preferably 99.99999 mass % or more and the content of S is preferably 0.02 mass ppm or less, and accordingly, the high-purity electrolytic copper can be used for various purposes requiring a high-purity copper.

In the embodiment, the area ratio of crystals having a (111)±10° orientation is suppressed to be less than 15%, in the cross section along the thickness direction (cross section along a growth direction of electrodeposition), and accordingly, the great growth of the crystals having a (111)±10° orientation due to the electrolytic reaction is prevented, and stress in electrodeposits during the electrodeposition is suppressed to be low. In addition, the orientation of crystals becomes random and the strain is easily relaxed. Accordingly, the occurrence of warpage of the plate-shaped high-purity electrolytic copper 10 peeled off from the cathode plate 1 is prevented, and good handleability is obtained.

In the embodiment, the area ratio of crystal grains, in which an aspect ratio b/a represented by a major axis a of the crystal grain size and a minor axis b orthogonal to the major axis a is less than 0.33, is less than 40% in the cross section along the thickness direction (cross section along the growth direction of electrodeposition), and accordingly, the great growth of crystals in one direction during the electrodeposition is prevented, and stress in electrodeposits during the electrodeposition decreases. Therefore, even after the electrolytic copper is peeled off from the cathode plate 1, the occurrence of warpage is prevented, and good handleability is obtained.

In the high-purity electrolytic copper 10 according to the embodiment, the average crystal grain size is set to be equal to or greater than 15 μm, the number of portions where crystal grains are fused decrease, and stress during the electrodeposition decreases. On the other hand, the average crystal grain size is set to be equal to or smaller than 35 μm, and accordingly, the surface of electrolytic copper is smooth, and the purity of the electrolytic copper can be held to be 99.9999 mass % or more. Therefore, stress remaining in the high-purity electrolytic copper 10 decreases, the occurrence of warpage can be prevented, and it is possible to obtain copper having a high purity.

In the high-purity electrolytic copper 10 according to the embodiment, the glossiness of the surface of the high-purity electrolytic copper 10 is 2 or more, and accordingly, it is possible to prevent inclusion of inevitable impurities and realizing a high purity as described above. In addition, in a case where the copper is electrodeposited smoothly on the surface of the cathode plate 1, stress in electrodeposits tends to increase, and as described above, it is possible to suppress stress in electrodeposits to be low, by regulating the orientation degree of crystals.

In the embodiment, as described above, three kinds of additives are added to the electrolyte, and accordingly, it is possible to obtain the high-purity electrolytic copper 10 having a high purity and a smooth surface. It is possible to suppress stress in electrodeposits during the electrodeposition to be low, and it is possible to stably produce the high-purity electrolytic copper 10 in which a residual stress is small and the occurrence of warpage is prevented.

Hereinabove, the embodiment of the invention has been described, and the invention is not limited thereto and can be suitably changed within a range not departing from a technical ideal of the invention.

For example, in the embodiment, the copper sulfate aqueous solution is used as the electrolyte, but there is no limitation thereto, and a copper nitrate aqueous solution may be used.

EXAMPLES

Hereinafter, results of an evaluation test obtained by evaluating the high-purity electrolytic copper according to the embodiment described above will be described.

As the electrolyte, two kinds of a copper sulfate aqueous solution including 50 g/L of sulfuric acid, 197 g/L of copper sulfate pentahydrate, and 50 mg/L of hydrochloric acid, and a copper nitrate aqueous solution including 5 g/L of nitric acid, 190 g/L of copper nitrate trihydrate, and 50 mg/L of hydrochloric acid were prepared. The electrolytes used are shown in Table 2.

The additive A, the additive B, and the additive C shown in Table 1 were respectively added to the electrolyte, as shown in Table 2.

An electrolytic copper (4NCu) having a sulfur concentration of 5 mass ppm or less, a silver concentration of 8 mass ppm or less, and a purity of 99.99 mass % or more was used as the anode plate. An anode bag was used so that slime generated from the anode plate are not included in the electrolytic copper.

A stainless steel sheet formed of SUS316 was used as the cathode plate.

The electrolysis was performed under the conditions of a current density of 150 A/m$^2$ and a bath temperature of 30° C. Regarding the additive A, the additive B, and the additive C, the amount of decrease was successively supplied, such that the concentrations in the initial stage were maintained.

Under the conditions described above, the copper is electrodeposited on a stainless steel sheet which is a cathode plate, and electrolytic coppers of present invention examples and comparative examples were obtained.

Regarding the electrolytic copper for performing the glossiness, the composition analysis, and the cross-sectional structure observation, was produced by performing the electrodeposition for 7 days under the conditions described above.

In addition, the electrolytic copper for evaluating the amount of a warpage was produced by performing the electrodeposition for 24 hours under the conditions described above.

(Composition Analysis)

A measurement sample was collected from a center portion of the obtained electrolytic copper, and contents of Ag, Al, As, Au, B, Ba, Be, Bi, C, Ca, Cd, Cl, Co, Cr, F, Fe, Ga, Ge, Hg, In, K, Li, Mg, Mn, Mo, Na, Nb, Ni, O, P, Pb, Pd, Pt, S, Sb, Se, Si, Sn, Te, Th, Ti, U, V, W, Zn, and Zr were measured by using a glow discharge mass spectrometer (GD-MS) (VG-9000 manufactured by VG MICROTRACE). Among these, the contents of all components excluding gas components (O, F, S, C, and Cl) were added and a total amount of inevitable impurities was obtained. The measurement result is shown in Table 3.

(Cross-Sectional Structure Observation)

A measurement sample was collected from a center portion of the obtained electrolytic copper, the cross section along the growth direction of electrodeposition (thickness direction of electrolytic copper) was processed by an ion milling method, the measurement was performed in a measurement range of 3500 μm×1000 μm and a measurement step of 3 μm, by using an EBSD apparatus (OIM Data Collection manufactured by EDAX/TSL) attached with FE-SEM (JSM-7001FA manufactured by JEOL Ltd.), and the analysis was performed by using data and analysis software (OIM Data Analysis ver. 5.2 manufactured by EDAX/TSL).

Under the conditions described in the embodiment described above, the area ratio of crystals having a (101) ±10° orientation, the area ratio of crystals having a (111) ±10° orientation, the area ratio of crystal grains, in which an aspect ratio b/a represented by a major axis a of a crystal grain size and a minor axis b orthogonal to the major axis a, is less than 0.33, and the average crystal grain size was evaluated. The evaluation result is shown in Table 3.

(Glossiness)

The glossiness of the surface of the electrolytic copper was measured under the condition of an angle of incidence of 60°, based on JIS Z 8741:1997 by using a gloss meter (HANDY GLOSSMETER PG-1M manufactured by NIPPON DENSHOKU Industries Co., Ltd.). The measured portion was the center portion of the electrolytic copper on the electrodeposited surface side. The evaluation result is shown in Table 3.

(Amount of Warpage)

As described above, a square plate-shaped electrolytic copper having a length of 10 cm on one side was obtained by electrodeposition for 24 hours, this was peeled off from the cathode plate, and the electrodeposited surface side was placed faceing upward and left on the flat plate for 24 hours. The distance between the flat plate and the four corners of the electrolytic copper in the height direction was measured, and an average value of the four points was evaluated as the amount of warpage. The evaluation result is shown in Table 3.

(Stress in Electrodeposits)

Stress in electrodeposits was measured under the same conditions as in Tables 1 and 2 by using strain gage type stress meter (manufactured by Yamamoto-Ms Co., Ltd.). For a value of the stress in electrodeposits, the value after 2 hours of the electrodeposition was used. For the cathode plate, an exclusive copper cathode plate belonging to the strain gage type stress meter attached with strain gage on the surface of the electrodeposited surface was used. The measured result is shown in Table 3.

TABLE 1

| | | |
|---|---|---|
| Additive A | A-1 | 5-amino-1H-tetrazole (Tokyo Chemical Industry Co., Ltd.) |
| | A-2 | 5-methyl-1H-tetrazole (Tokyo Chemical Industry Co., Ltd.) |
| | A-3 | 5-phenyl-1H-tetrazole (Tokyo Chemical Industry Co., Ltd.) |
| Additive B | B-1 | Polyethylene glycol having average molecular weight of 2000 (Tokyo Chemical Industry Co., Ltd.) |
| | B-2 | Polyoxyethylene monophenyl ether having additive mol number of ethylene oxide of 10 (AOKI OIL INDUSTRIAL Co., Ltd. PH-10) |
| | B-3 | Polyoxyethylene Naphthyl ether having additive mol number of ethylene oxide of 10 (DKS Co. Ltd. INOGEN EN-10) |
| Additive C | C-1 | Polyvinyl alcohol having saponification rate of 96.5 mol % and average polymerization degree of 2600 (JAPAN VAM & POVAL Co., Ltd. JM-26) |
| | C-2 | Carboxy-modified polyvinyl alcohol having saponification rate of 85 mol % and average polymerization degree of 250 (Kuraray Co., Ltd. SD-1000) |
| | C-3 | Polyvinyl alcohol having saponification rate of 88 mol % and average polymerization degree of 500 (JAPAN VAM & POVAL Co., Ltd. JP-05) |

TABLE 2

| | | | Additive A | | Additive B | | Additive C | |
|---|---|---|---|---|---|---|---|---|
| | | Electrolyte | Kind | Concentration (mg/L) | Kind | Concentration (mg/L) | Kind | Concentration (mg/L) |
| Present invention example | 1 | Sulfuric acid | A-3 | 5 | B-2 | 100 | C-2 | 75 |
| | 2 | Sulfuric acid | A-1 | 15 | B-2 | 100 | C-2 | 10 |
| | 3 | Sulfuric acid | A-1 | 2 | B-2 | 100 | C-2 | 25 |

TABLE 2-continued

| | | Electrolyte | Additive A Kind | Additive A Concentration (mg/L) | Additive B Kind | Additive B Concentration (mg/L) | Additive C Kind | Additive C Concentration (mg/L) |
|---|---|---|---|---|---|---|---|---|
| | 4 | Sulfuric acid | A-2 | 8 | B-2 | 100 | C-2 | 1 |
| | 5 | Sulfuric acid | A-2 | 0.2 | B-3 | 100 | C-2 | 40 |
| | 6 | Sulfuric acid | A-3 | 2 | B-2 | 100 | C-3 | 10 |
| | 7 | Nitric acid | A-2 | 2 | B-1 | 100 | C-2 | 10 |
| Comparative example | 1 | Nitric acid | A-1 | 5 | B-1 | 100 | C-2 | 10 |
| | 2 | Sulfuric acid | A-1 | 5 | B-2 | 100 | C-1 | 10 |
| | 3 | Sulfuric acid | A-2 | 5 | B-2 | 100 | C-2 | 0.5 |
| | 4 | Sulfuric acid | None | | B-3 | 100 | C-2 | 200 |
| | 5 | Sulfuric acid | A-1 | 0.01 | B-2 | 100 | C-2 | 10 |
| | 6 | Sulfuric acid | A-1 | 25 | B-2 | 100 | C-3 | 10 |

TABLE 3

| | | Structure analysis (mass ppm) S | Ag | Total amount of inevitable impurities | Purity of Cu (mass %) | Stress in electro-deposits (MPa) | Orientation of crystals (101) ± 10° area ratio (%) | (111) ± 10° area ratio (%) | Area ratio in which aspect ratio b/a is less than 0.33 (%) | Average crystal grain size (μm) | Glossiness | Amount of warpage (cm) |
|---|---|---|---|---|---|---|---|---|---|---|---|---|
| Present invention example | 1 | 0.053 | 0.09 | 0.113 | >99.99995 | 35 | 30.4 | 10.9 | 32.6 | 17.4 | 2.8 | 0.0 |
| | 2 | 0.042 | 0.09 | 0.124 | >99.99995 | 41 | 35.3 | 12.1 | 29.8 | 19.1 | 3.3 | 0.0 |
| | 3 | 0.018 | 0.06 | 0.083 | >99.99999 | 19 | 25.1 | 9.8 | 11.5 | 34.6 | 2.5 | 0.0 |
| | 4 | 0.011 | 0.08 | 0.099 | >99.99999 | 22 | 22.7 | 9.0 | 18.9 | 18.5 | 3.1 | 0.0 |
| | 5 | 0.002 | 0.07 | 0.098 | >99.99999 | 25 | 20.1 | 8.4 | 14.4 | 26.3 | 3.3 | 0.0 |
| | 6 | 0.004 | 0.05 | 0.071 | >99.99999 | 20 | 12.1 | 6.4 | 13.8 | 17.4 | 3.4 | 0.0 |
| | 7 | 0.007 | 0.04 | 0.064 | >99.99999 | 24 | 11.3 | 5.7 | 16.8 | 22.4 | 3.7 | 0.0 |
| Comparative example | 1 | 0.062 | 0.17 | 0.215 | >99.99995 | 65 | 58.1 | 17.5 | 49.9 | 14.5 | 3.5 | 2.1 |
| | 2 | 0.186 | 0.21 | 0.243 | >99.99995 | 55 | 51.3 | 15.4 | 51.7 | 13.8 | 2.4 | 1.5 |
| | 3 | 0.098 | 0.34 | 0.361 | >99.99995 | 61 | 56.4 | 16.6 | 45.3 | 13.2 | 2.2 | 1.1 |
| | 4 | 0.125 | 0.92 | 0.974 | >99.99990 | 37 | 37.3 | 12.6 | 39.8 | 25.2 | 1.8 | 0.0 |
| | 5 | 0.253 | 0.88 | 0.901 | >99.99990 | 41 | 39.1 | 13.1 | 41.1 | 25.3 | 1.5 | 0.0 |
| | 6 | 0.371 | 0.54 | 0.576 | >99.99990 | 55 | 42.3 | 13.8 | 35.7 | 14.9 | 0.4 | 0.8 |

In Comparative Examples 1 to 3 and 6, the area ratio of crystals having a (101)±10° orientation was greater than 40%, and a warpage of electrolytic copper was increased. It was confirmed that stress in electrodeposits during the electrodeposition under the same conditions was increased.

In Comparative Examples 4, 5, and 6, the content of S was high, and the total amount of inevitable impurities was also comparatively high. In addition, it was expected that, the glossiness was low, ruggedness was generated during the electrodeposition, the electrolyte was captured, and accordingly, the purity was decreased.

With respect to this, in Present Invention Examples 1 to 7, the area ratio of crystals having a (101)±10° orientation was less than 40% and a warpage of the electrolytic copper was not confirmed. It was confirmed that stress in electrodeposits during the electrodeposition under the same conditions was low. The content of S was decreased, and a total amount of inevitable impurities was suppressed to be low, and it was possible to obtain an electrolytic copper having a high purity.

From the above viewpoints, according to the invention, it was confirmed that, it is possible to a high-purity electrolytic copper that has a purity of Cu excluding gas components of 99.9999 mass % or more, has a content of S of 0.1 mass ppm or less, is stably produced by decreasing stress in electrodeposits during electrodeposition, and has good handleability by preventing the occurrence of warpage, even after being peeled off from a cathode plate.

INDUSTRIAL APPLICABILITY

According to the invention, it is possible to provide a high-purity electrolytic copper that has a purity excluding gas components of 99.9999 mass % or more, has a content of S of 0.1 mass ppm or less, is stably produced by decreasing stress in electrodeposits during electrodeposition, and has excellent handleability by preventing the occurrence of warpage, even after being peeled off from a cathode plate.

REFERENCE SIGNS LIST

1: cathode plate
10: high-purity electrolytic copper

The invention claimed is:

1. A high-purity electrolytic copper, wherein a Cu purity excluding gas components (O, F, S, C, and Cl) is 99.9999 mass % or more, a content of S is 0.1 mass ppm or less, a content of Ag is 0.001 mass ppm or more and 0.1 mass ppm or less, an area ratio of crystals having a (101)±10° orientation is less than 40%, when crystal orientation is measured by electron backscatter diffraction in a cross section along a thickness direction, and a glossiness of a surface of the high-purity electrolytic copper is 2 or more and 4.5 or less.

2. The high-purity electrolytic copper according to claim 1, wherein an area ratio of crystals having a (111)±10° orientation is less than 15%, when crystal orientation is measured by electron backscatter diffraction in the cross section along the thickness direction.

3. The high-purity electrolytic copper according to claim 1, wherein an area ratio of crystal grains, in which an aspect ratio b/a represented by a major axis a of the crystal grain and a minor axis b orthogonal to the major axis a is less than 0.33, is less than 40% in the cross section along the thickness direction.

4. The high-purity electrolytic copper according to claim 1, wherein the Cu purity excluding gas components (O, F, S, C, and Cl) is 99.99999 mass % or more and the content of S is 0.02 mass ppm or less.

5. The high-purity electrolytic copper according to claim 2, wherein an area ratio of crystal grains, in which an aspect ratio b/a represented by a major axis a of the crystal grain and a minor axis b orthogonal to the major axis a is less than 0.33, is less than 40% in the cross section along the thickness direction.

6. The high-purity electrolytic copper according to claim 2, wherein the Cu purity excluding gas components (O, F, S, C, and Cl) is 99.99999 mass % or more and the content of S is 0.02 mass ppm or less.

7. The high-purity electrolytic copper according to claim 3, wherein the Cu purity excluding gas components (O, F, S, C, and Cl) is 99.99999 mass % or more and the content of S is 0.02 mass ppm or less.

8. The high-purity electrolytic copper according to claim 5, wherein the Cu purity excluding gas components (O, F, S, C, and Cl) is 99.99999 mass % or more and the content of S is 0.02 mass ppm or less.

* * * * *